US005166472A

United States Patent [19]

Maeda et al.

[11] Patent Number: 5,166,472

[45] Date of Patent: Nov. 24, 1992

[54] DEVELOPING DEVICE HAVING A POROUS PLATE

[75] Inventors: Masahiko Maeda, Izumiotsu; Yasuhiro Koshijima, deceased, late of Itami, by Kisaku Koshijima, legal representative; Osamu Takemura, Nishinomiya, all of Japan

[73] Assignee: Mita Industrial Co., Ltd., Osaka, Japan

[21] Appl. No.: 739,158

[22] Filed: Aug. 1, 1991

[30] Foreign Application Priority Data

Aug. 2, 1990 [JP] Japan ..... 2-206451

[51] Int. Cl.[5] ..... G03G 15/08

[52] U.S. Cl. ..... 118/653; 355/262; 355/261; 355/259; 355/245

[58] Field of Search ..... 355/262, 263, 265, 261, 355/259, 245; 118/653, 656, 644

[56] References Cited

U.S. PATENT DOCUMENTS 4,395,110 7/1983 Hosono et al. ..... 118/657

FOREIGN PATENT DOCUMENTS 56-123554 9/1981 Japan .
60-103374 6/1985 Japan .
61-179473 8/1986 Japan .

*Primary Examiner*—Richard L. Moses
*Attorney, Agent, or Firm*—Armstrong & Kubovcik

[57] ABSTRACT

A developing device which includes a housing including an opening toward a photosensitive drum, the housing containing a single-component toner, a developing roller disposed in the opening facing the photosensitive drum so as to transfer the toner to an image-forming area between the developing roller and the photosensitive drum, a porous plate disposed in the opening and kept in contact with the part of the developing roller which is positioned in the housing, the porous plate having pores of such a size so as to allow the toner to pass through, and a toner supply means for supplying the toner from the housing to the porous plate.

11 Claims, 12 Drawing Sheets

DEVELOPING DEVICE HAVING A POROUS PLATE

BACKGROUND OF THE INVENTION

1. Field of the Invention

The present invention relates to a developing device used in electrophotographic printers, and more particularly to a developing device for developing a latent image formed on a photosensitive drum with a single-component developer.

2. Background of the Prior Art

It is known that a latent image formed on a photosensitive drum is developed by a developing device. For a developer a two-component developer including a toner and a carrier or a single-component developer including a toner alone is used. In recent years a single-component developer is preferred to the two-component developer because of the non-necessity of adjusting the mixing ratio of toner and carrier, and the non-possibility of the toner being unfavorably influenced by the deteriorating carrier.

A developing device using a single-component developer is equipped with a developing roller for feeding a toner charged with a predetermined polarity. The amount of the developer to be fed is controlled by a blade made of an elastic material such as rubber, thereby forming a thin toner layer on the developing roller. When the toner layer on the developing roller reaches a face-to-face position with the photosensitive drum, the developer is transferred to the image-forming area so as to develop the latent image.

In the developing device using a single-component developer it is essential to cover the surface of the developing roller with an evenly thin toner layer, otherwise it will not be possible to develop the image on the photosensitive drum with equal density. As described above, the blade used to control the amount of toner to be fed is axially slid on the whole surface of the developing roller. However, it is difficult to enable the blade to keep contact on the developing roller with a constant pressure throughout the whole surface of the peripheral surface of the developing roller. In recent years, the developing roller tends to have a reduced diameter such as 20 mm, and it becomes difficult for the blade to keep full contact with the whole surface of such a relatively small roller. As a result, the toner layer becomes uneven, and the latent image cannot be developed with equal density.

Japanese Laid-Open Patent Publication No. 61-179473 discloses a container for containing a two-component developer, that is, a toner and a carrier of magnetic particles, and a mesh for allowing the toner alone to pass to a developing roller where an image is developed. A problem arises when a black solid image is formed with a relatively large amount of toner, the carrier having relatively large particles tend to clog the mesh, thereby causing a shortage of toner supply to the developing roller. As a result, the formed image is unclear.

In the case of a single-component developer without a carrier, no such problems arise. However, it is difficult for a sufficient amount of toner to be supplied to the developing roller because of the absence of a carrier which otherwise would be effective to entrain the toner to the mesh. As a result, an unclear image results.

Japanese Laid-Open Patent Publication No. 56-123554 discloses a developing device which allows a single-component developer to pass through a screen. In this developing device the screen keeps contact with the peripheral surface of the developing roller, and the toner passing through the screen forms a thin layer on the developing roller. In order to enable the toner to pass through the screen, a high pressure is required. The toner used in a single-component developer has relatively large particles such as 10 μm in diameter. Such large particles are likely to cause a choking trouble in the screen. In this situation, if the toner is pressed to the screen at a high pressure, the toner is gathered into masses, thereby causing a secondary choking problem. Owing to the shortage of toner supply resulting from the choking, an evenly thin toner layer fails to be formed on the developing roller. If the pressure is reduced, the screen becomes safe from the choking problem, but the amount of toner that passes through the screen is decreased. A shortage of toner also occurs, and the density of the resulting image becomes inadequate. In the developing device disclosed in Japanese Laid-Open Patent Publication No. 56-123554 the toner forcing pressure is constant, but as the amount of toner changes, the required pressure accordingly changes, thereby changing the supply of toner to the developing roller. As a result, the density of the resultant image becomes uneven.

SUMMARY OF THE INVENTION

The developing device of this invention, which overcomes the above-discussed and numerous other disadvantages and deficiencies of the prior art, comprises a housing including an opening toward a photosensitive drum, the housing containing a single-component toner, a developing roller disposed in the opening facing the photosensitive drum so as to transfer the toner to an image-forming area between the developing roller and the photosensitive drum, a porous plate disposed in the opening and kept in contact with the part of the developing roller which is positioned in the housing, the porous plate having pores of such a size so as to allow the toner to pass through, and a toner supply means for supplying the toner from the housing to the porous plate.

In a preferred embodiment, the toner supplying means is a roller.

In a preferred embodiment, the developing device further comprises a first means for charging the toner with a desired polarity, and a second means for generating an electric field between the toner supply means and the developing roller whereby the charged toner is electromagnetically attracted to the developing roller.

In a preferred embodiment, the porous plate comprises means for being fixed to the housing, the fixing means comprising means for equalizing the pressure acting on the developing roller.

In a preferred embodiment, the porous plate is not shorter than the axial length of the developing roller so that the porous plate is kept in contact with the full axial length of the developing roller.

In a preferred embodiment, the developing roller has an equal diameter at each end and has a smaller diameter in a central portion than that at the end.

In a preferred embodiment, the porous plate is provided with means for adjusting the pressure of the porous plate to the developing roller, the pressure adjusting means comprising means for adjusting the position of the porous plate with respect to the housing.

In a preferred embodiment, the porous plate has a shorter length than the axial length of the developing roller and the opposite edges of the porous plate are covered with strips on the sides where the porous plate is kept in contact with the developing roller.

In a preferred embodiment, the porous plate is provided with means for keeping the porous plate in contact with the developing device under an appropriate pressure applied along the axial length of the developing roller.

Alternatively, the developing device comprises a housing including an opening toward a photosensitive drum, the housing containing a single-component toner, a developing roller disposed in the opening facing the photosensitive drum so as to transfer the toner to an image-forming area between the developing roller and the photosensitive drum, a porous plate disposed in the opening so as to cover the opening thereof and having pores of such a size so as to allow the toner to pass through, and a toner collecting means for collecting toner through the porous plate.

In a preferred embodiment, the toner collecting means comprises a window disposed on the porous plate, and having a larger opening than the pores of the porous plate.

In a preferred embodiment, the toner collecting means comprises an electrode having an opposite polarity to that of the toner so as to magnetically attract the toner.

In a preferred embodiment, the toner collecting means comprises a vibrator for imparting vibration to the porous plate.

Thus, the invention described herein makes possible the objectives of (1) providing a developing device capable of allowing toner to pass through a porous plate without difficulty, (2) providing a developing device capable of charging the toner by friction with the porous plate and the developing roller as required, thereby facilitating the formation of a toner thin layer on the developing roller, and (3) capable of developing a latent image with an optimum amount of toner.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Example 1

Figure 1:
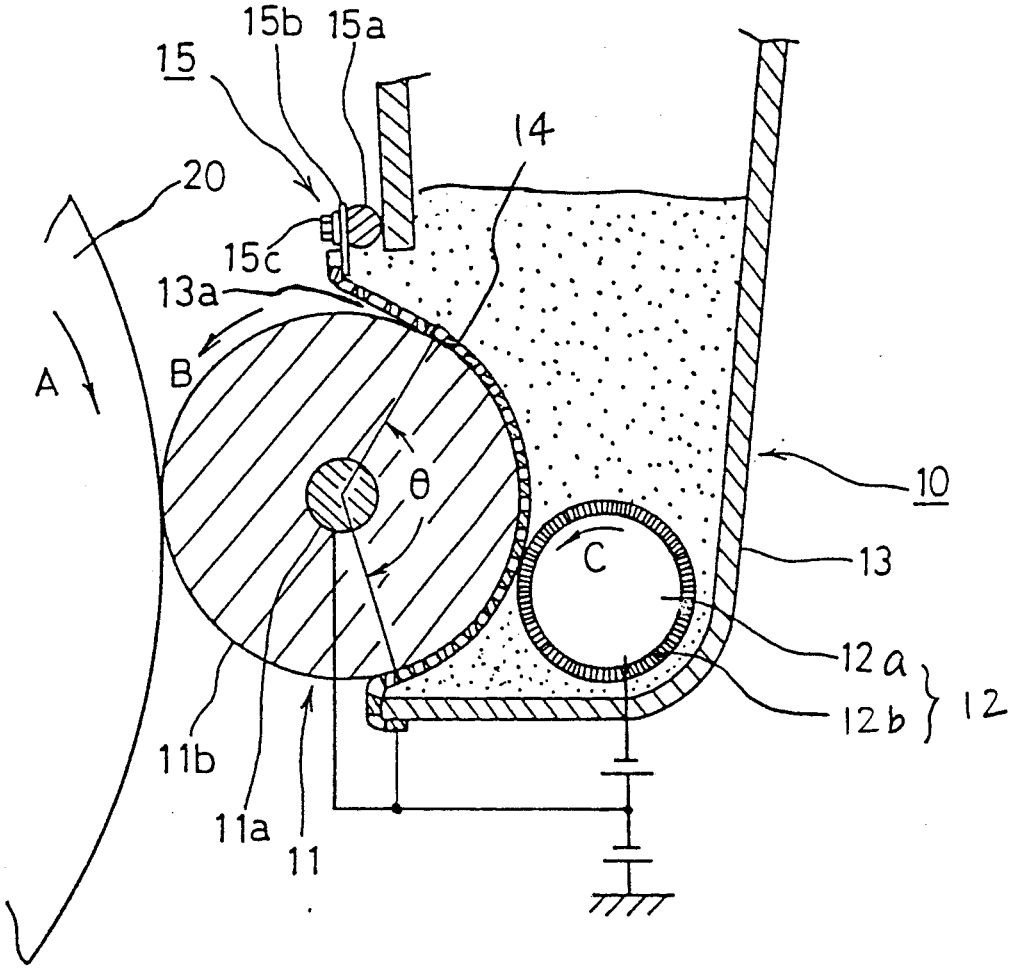
FIG. 1 is a cross-sectional view showing a developing device according to the present invention.

Referring to FIG. 1, a developing device 10 is situated on the opposite side of a photosensitive drum 20 on which an image is formed. The developing device 10 includes a housing 13 having an opening 13*a* toward the drum 20, and a developing roller 11. The housing 13 houses a single-component non-magnetic toner which is negatively charged by rubbing.

The developing roller 11 has a core metal shaft 11*a* covered with urethane rubber 11*b* having a volume resistivity of $10^7\ \Omega$. The developing roller 11 and the drum 20 mutually keep contact. As an alternative embodiment, the developing roller 11 is positioned nearest to the photosensitive drum 20. Whether it is a contact point or a non-contact point, the point will be referred to as the "image-forming area". When the drum 20 is rotated in the direction of arrow A, the drive is transmitted to the developing roller 11, so as to rotate the developing roller to rotate in the direction of B. The contact surfaces of the drum 20 and the developing roller 11 move in the forward direction.

Figure 2:
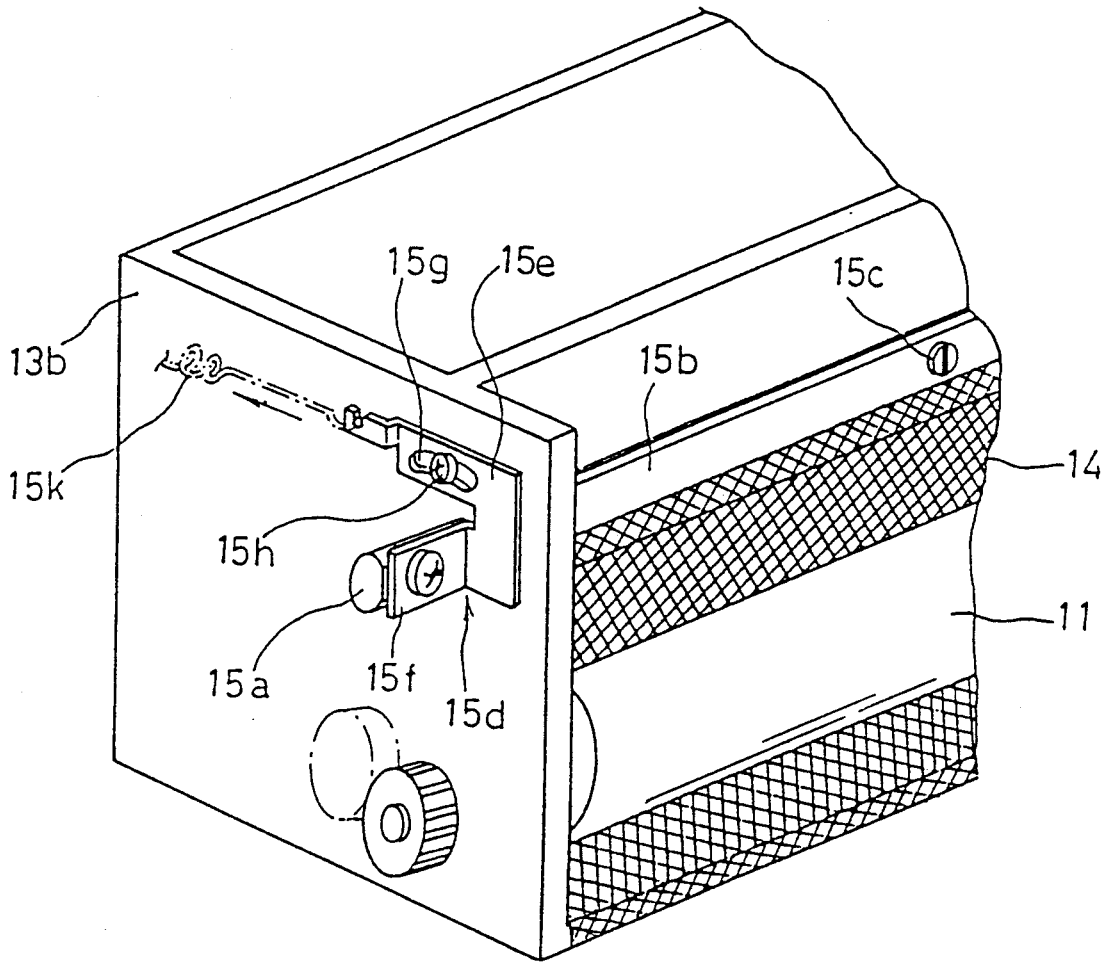
FIG. 2 is a perspective view showing the main portion of the developing device of FIG. 1.
Figure 3:
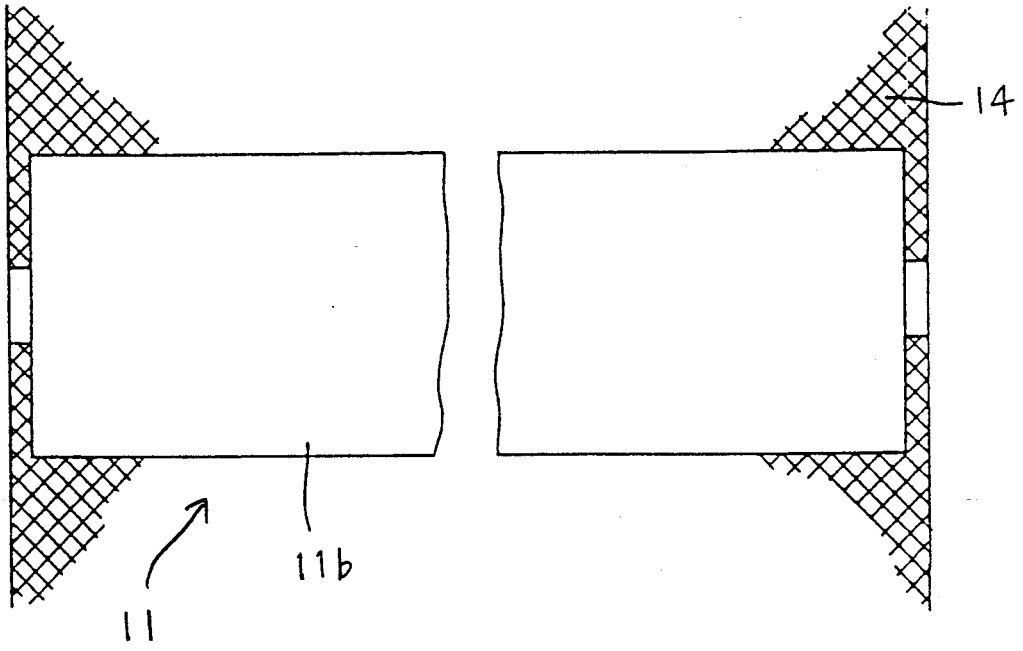
FIG. 3 is a schematic view showing the positional relationship between the developing roller and the mesh plate shown in FIG. 1.

As shown in FIG. 2, the opening 13*a* is covered by a resilient porous electroconductive mesh plate 14, such as a thin metal porous plate.

The mesh plate 14 is kept in contact with the portion of the peripheral surface of the developing roller 11 which is covered by angle $\theta$. The angle $\theta$ is normally not larger than 180°. The mesh plate 14 is longer than the axial length of the urethane rubber 11*b* of the developing roller 11. The journals of the developing roller 11 are supported on the respective side plates of the housing 13. The opening 13*a* is completely covered by the mesh plate 14. The ends of the mesh plate 14 are connected in an airtight fashion to the side walls 13*b* of the housing 13, thereby preventing the toner from leaking through the seal between the housing 13 and the mesh plate 14.

The mesh plate 14 is fixed to a fixing unit 15 and a lower edge of the housing 13. The fixing unit 15 is designed to stretch the mesh plate 14 in the direction in which the developing roller is rotated. The fixing unit 15 includes a rotary shaft 15*a* whose ends are passed through the side walls 13*b* as shown in FIG. 2, and a front panel 15*b*. The boss of the rotary shaft 15*a* is partly chamfered so as to have the front panel 15*b* secured to the rotary shaft 15*a* by means of a screw 15*c*. By loosening the screw 15*c*, the rotary shaft 15*a* and the front panel 15*b* can be slightly rotated.

The projecting end of the rotary shaft 15*a* is provided with a bracket 15*d* including a base plate 15*e* and an arm portion 15*f*. The base plate 15*e* includes a slot 15*g* through which a screw 15*h* is passed and fixed to the side wall 13*b*. When the screw 15*h* is unfastened, the bracket 15*d* can move alongside the side wall 13*b* by the distance corresponding to the length of the slot 15*g*. The bracket 15*d* is placed under tension by means of a spring 15*k* whose one end is fixed to the side wall 13*b*. When the mesh plate 14 is kept in contact with the developing roller 11 under an adequate pressure owing to the tension imparted to the rotary shaft 15*a*, the screw 15*h* is tightened so as to fix the bracket 15*d* to the side wall 13*b*.

Figure 4:
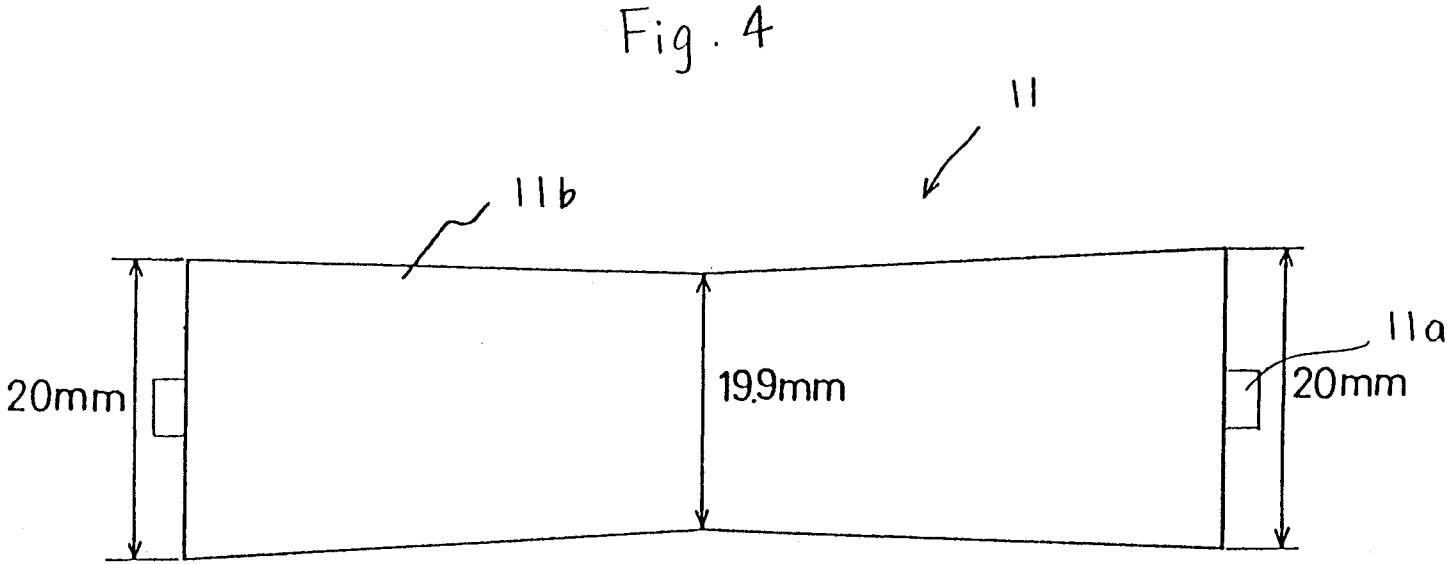
FIG. 4 is a front view showing the developing roller.

The urethane rubber 11*b* of the developing roller 11 has equal diameters at both ends as shown in FIG. 4; in the illustrated embodiment, the outside diameters are 20 mm. The diameter of the central portion is about 0.1 mm smaller than those at both ends, that is, 19.9 mm. The basic configuration of the urethane rubber 11*b* is concave at the center and convex at both ends, hereinafter referred to as "reverse crown shape". The developing roller 11 is disposed in relation to the drum 20 in such a manner that both convex end portions are further pressed against the drum 20 by about 0.05 mm. In this arrangement the reverse crown configuration is advantageous in that when the urethane rubber 11*b* is pressed against the drum 20, the whole surface of the urethane rubber 11*b* is kept in full contact with the drum surface.

The housing 13 includes a toner supply roller 12 whereby the toner is supplied to the developing roller 11. The supply roller 12 is kept in contact with the developing roller 11 through the mesh plate 14 and includes a shaft 12*a* covered by an electroconductive fur brush 12*b* having an electric resistance of about $10^4$ Ω. The fur brush 12*b* is made of rayon containing carbon. In the illustrated embodiment, the supply roller 12 has a smaller diameter than the developing roller 11. The top portion of the supply roller 12 is lower than that of the developing roller 11. The directions of rotation of the two rollers 11 and 12 are the same, thereby enabling the toner to move to the mesh plate 14 and pass therethrough to reach the developing roller 11.

The toner supply roller 12 is not limited to the illustrated position, size and material, but can be variously made, depending upon the size of the developing roller and the kinds of toner to be used. For example, sponge can be used instead of urethane.

The toner in common use contains particles having a grain size of about 10 μm and the mesh plate 14 for such toner has a mesh of 100 to 400, that is, the porosity is in the range of 40 to 150 μm. The mesh is made of lines having diameters of 40 to 80 μm.

A bias voltage of −100 V or so is applied to the core metal shaft 11*a* of the developing roller 11, and a bias voltage of −300 V is applied to the core metal shaft 12*a* of the toner supply roller 12. The mesh plate 14 is negatively charged, that is, the same polarity as that of the toner, and a voltage of −300 v is applied thereto.

When the photosensitive drum 20 and the developing roller 11 are kept in contact with each other, an elastic material such as the urethane rubber of the developing roller is advantageous in that the friction is lessened. The urethane rubber 11*b* preferably has a roughness of 2 to 20 μm. This degree of roughness is advantageous in that the toner is smoothly transferred by the urethane rubber surface, and forms a layer having a thickness of 20 to 30 μm in accordance with the rotation of the developing roller 11. While it is transferred, the toner is charged by friction with the surface of the developing roller 11 and the mesh plate 14.

In this example, a latent image on the photosensitive drum 20 is developed by a reversal developing method such as a laser printer. The photosensitive drum 20 uses an OPC, and a surface voltage of −700 V is applied. The image is exposed to a laser beam. The potential in the exposed part is attenuated, and the latent image is formed. Since the developing roller 11 has a bias voltage of −100 V, the toner sticks to the part of the latent image on the photosensitive drum 20 where the surface potential is attenuated to form an image.

In this type of developing device 10 the toner supplied in the housing 13 is fed to the mesh plate 14 by the supply roller 12. When the toner reaches the area of contact between the supply roller 12 and the developing roller 11, it is crashed by the supply roller 12, and negatively charged by an electric field generated by a potential between the core metal shafts 11*a* and 12*a*. Thus, the negatively charged toner is attracted to the developing roller 11 and passed through the mesh of the mesh plate 14. The toner is carried by the developing roller 11 to the area of contact between the developing roller 11 and the photosensitive drum 20. While it is transferred, the toner is fully charged by friction with the developing roller 11 and the mesh plate 14, thereby forming an evenly thin layer on the urethane rubber 11*b*. When this toner layer reaches the area of contact between the developing roller 11 and the photosensitive drum 20, the toner develops the latent image on the drum 20 in this area.

Since the mesh plate 14 is charged as negatively as the toner, the toner in the housing 13 is repelled by the negative charge of the mesh plate 14, thereby preventing the toner from passing through the mesh plate 14.

The toner in the housing 13 is pushed by the supply roller 12 toward the developing roller 11, and forced through the mesh plate 14 even though it aggregates in mass. If the toner is not pushed by the supply roller 12, a good image cannot be formed because of the shortage of toner.

An electric field is formed between the supply roller 12 and the developing roller 11, so that the toner is transferred from the supply roller 12 to the developing roller 11, thereby enabling the toner to pass through the mesh plate 14 to form a toner layer on the developing roller 11. Under this arrangement by changing the intensity of electric field between the supply roller 12 and the developing roller 11, the amount of toner passing through the mesh plate 14 is varied, thereby setting the density of the image as desired.

The mesh plate 14 is adjusted so as to be kept in contact with the developing roller at an adequate pressure. The adjustment is carried out by unfastening the screw 15*h* and moving the bracket 15*d* to the left or right. When the adjustment is finished, the mesh plate 14 is fixed to the side wall 13*b*.

The upper edge of the mesh plate 14 can rotate around the screw 15*c*, and if the mesh plate 14 is twisted with respect to the developing roller 11, the positional deviation can be readily remedied, thereby ensuring that the mesh plate 14 is constantly kept in contact with the developing roller 11.

The mesh plate 14 is kept in contact with the developing roller 11 in a peripheral direction, and individual toner particles are charged by friction with the mesh plate 14.

The mesh plate 14 which is longer than the axial length of the developing roller 11 is kept in full contact therewith, thereby forming a toner layer throughout the axial length of the developing roller 11. This is particularly advantageous when the pressure development is effected by the photosensitive drum 20 in that the friction between the drum 20 and the developing roller 11 is lessened owing to the presence of the toner layer. This eliminates the necessity of using a large-powered driving mechanism, thereby saving energy and cost. The mesh plate 14 completely covers the opening 13*a*, thereby preventing the toner from leaking through gaps between the mesh plate 14 and the housing 13. This is an advantage over the known developing devices in which the toner in the housing is imperfectly sealed from leakage by means of an extra sponge or brush. Scattered toner particles are likely to spoil the image quality.

In the illustrated embodiment a metal mesh is used, but instead, insulating plastics such as nylon can be used. Alternatively, any other porous plates made by etching, etc. can be used.

The unit of the developing roller 11, the toner supply roller 12 and the housing 13 can be applied to an arrangement in which the photosensitive drum 20 and the developing roller 11 are kept in contact with each other. A belt covered with a photosensitive medium can be used instead of the photosensitive drum 20.

In order to facilitate the passage of toner through the mesh plate 14, a supersonic resonator using a piezoelectric element such as a PZT can be fitted to the mesh plate 14 through an insulator film. An alternating current is applied to the supersonic resonator so as to generate supersonic wave oscillation which is transmitted to the mesh plate 14. By modulating the frequency of the a. c. electric field, an appropriate vibration is imparted to the mesh plate 14 so as to enable the toner to pass through the mesh plate 14.

Example 2

Figure 5:
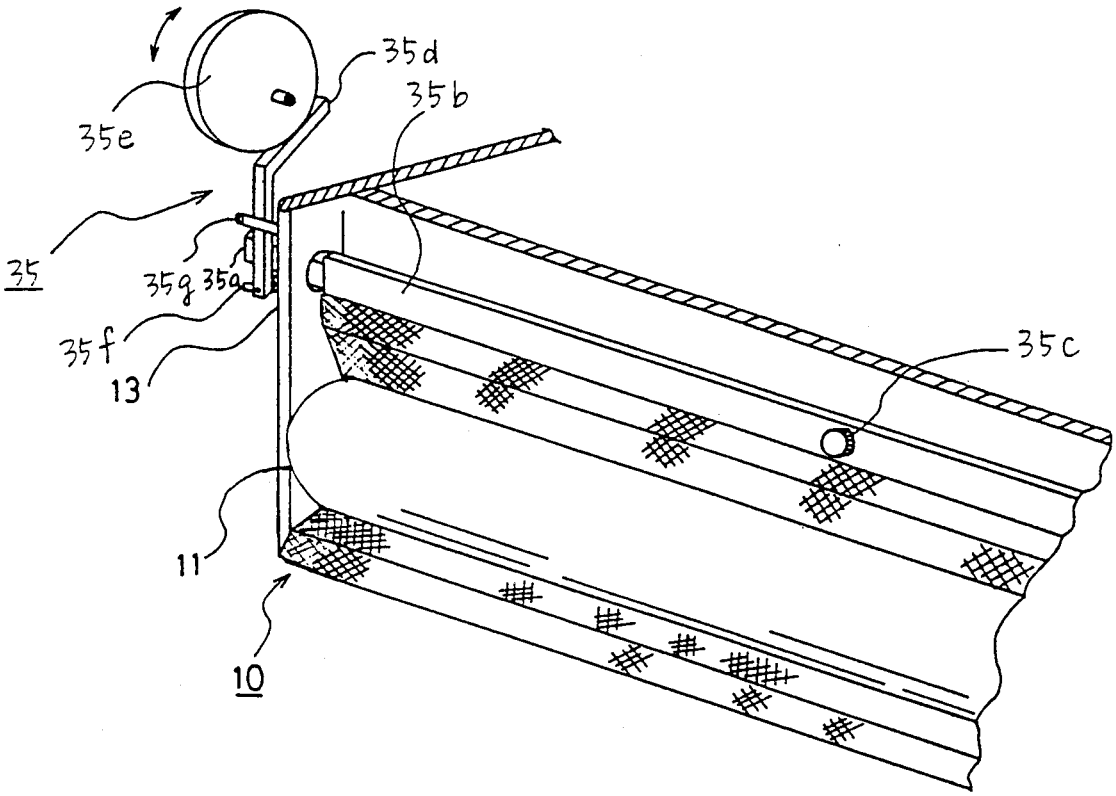
FIG. 5 is a cross-sectional view showing a modified version of the developing device according to the present invention.

Referring to FIG. 5, this example is different from Example 1 in that an adjusting device 35 is provided instead of the fixing unit 15, thereby enabling the mesh plate 14 to be kept in contact with the developing roller at an appropriate pressure. The adjusting device 35 includes a rotary shaft 35*a* carried on side walls 13*b* of the housing 13 along the opening 13*a* thereof, a connecting rod 35*b* extended axially with the rotary shaft 35*a*, and a pin 35*c*.

The rotary shaft 35*a* is chamfered to form a flat surface on which the connecting rod 35*b* is supported. The rotary shaft 35*a* is fixed to the connecting rod 35*b* by the pin 35*c*. By releasing the tension on the pin 35*c*, the connecting rod 35*b* can be rotated around the pin 35*c*.

Figure 6:
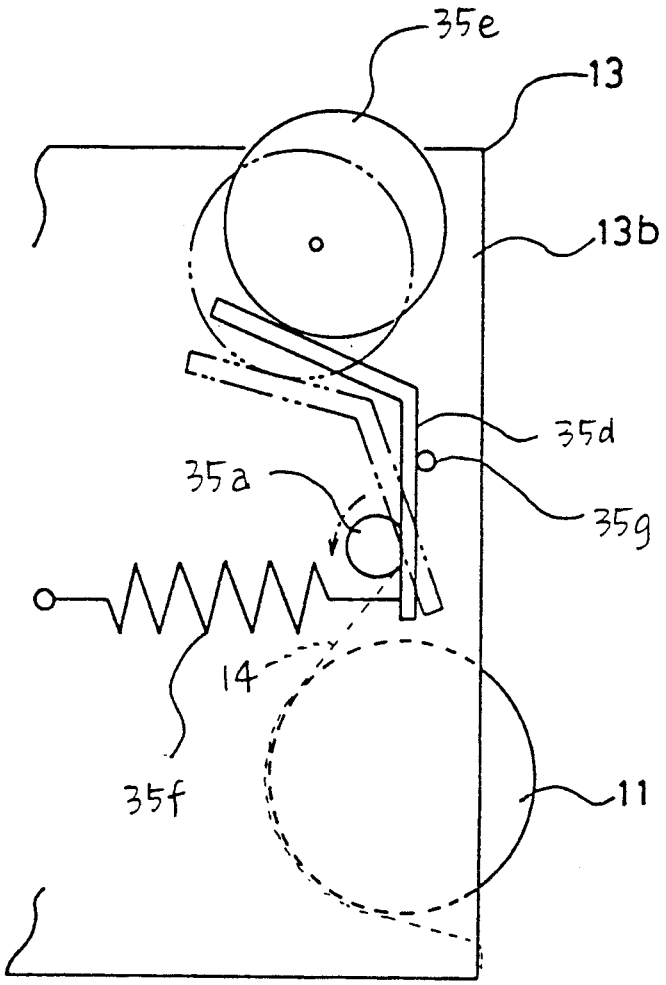
FIG. 6 is a device for adjusting the pressure of the mesh plate over the developing device.

Referring to FIG. 6, one end of the rotary shaft 35*a* is passed through one of the side walls 13*b*. The chamfered surface of the projecting end portion of the rotary shaft 35*a* supports an end of a rotary lever 35*d*. The rotary lever 35*d* extends upward and is bent in the opposite direction to the photosensitive drum 20. This lever 35*d* touches an eccentric cam 35*e* mounted on an image forming apparatus (not shown). The eccentric cam 35*e* is intermittently driven by a stepping motor or the like.

The other end of the rotary lever 35*d* is connected to a spring 35*f* which is fixed to the side wall 13*b* at the other end. The spring 35*f* biases the rotary lever 35*d* so as to enable it to touch the eccentric cam 35*e* constantly. The rotary lever 35*d* is stopped at a desired position by a stop pin 35*g* fixed on the side wall 13*b*. When the eccentric cam 35*e* is rotated, the rotary lever 35*d* is rotated against the spring 35*f* so that the mesh plate 14 can be kept in contact with the developing roller at an appropriate pressure. The eccentric cam 35*e* is rotated by the stepping motor. Preferably, the stepping motor is connected to an image density adjusting switch disposed on a control panel so that the stepping motor is rotated a given number of times.

When the density of an image is to be lowered, the eccentric cam 35*e* is rotated until the state shown by the chain line in FIG. 6 is reached, thereby causing the rotary lever 35*d* to rotate against the spring 35*f*. As a result, the rotary shaft 35*a* is rotated so as to pull the mesh plate 14 upward, thereby placing the mesh plate 14 into contact with the developing roller 11.

If the mesh plate 14 is excessively pressed upon the developing roller 11, the formation of a thin toner layer results on the developing roller 11. As a result, the latent image on the photosensitive drum 20 is developed with low density because of the shortage of toner. If the mesh plate 14 is lightly pressed upon the developing roller 11, the formation of a thick toner layer results on the developing roller 11, and the latent image on the photosensitive drum 20 is developed with high density because of the extra amount of toner.

When the mesh plate 14 is to be kept in contact with the developing roller 11 at a relatively small pressure, the rotary shaft 35*a* is stopped after it is rotated by a given amount.

When no image is formed, the eccentric cam 35*e* is rotated until no tension is imparted to the mesh plate 14, thereby releasing the developing roller 11 from the photosensitive drum 20. Thus, no tension is imparted to the mesh plate 14. This is particularly advantageous when the mesh is made of a plastic such as nylon which is permanently elongated.

Example 3

Figure 7:
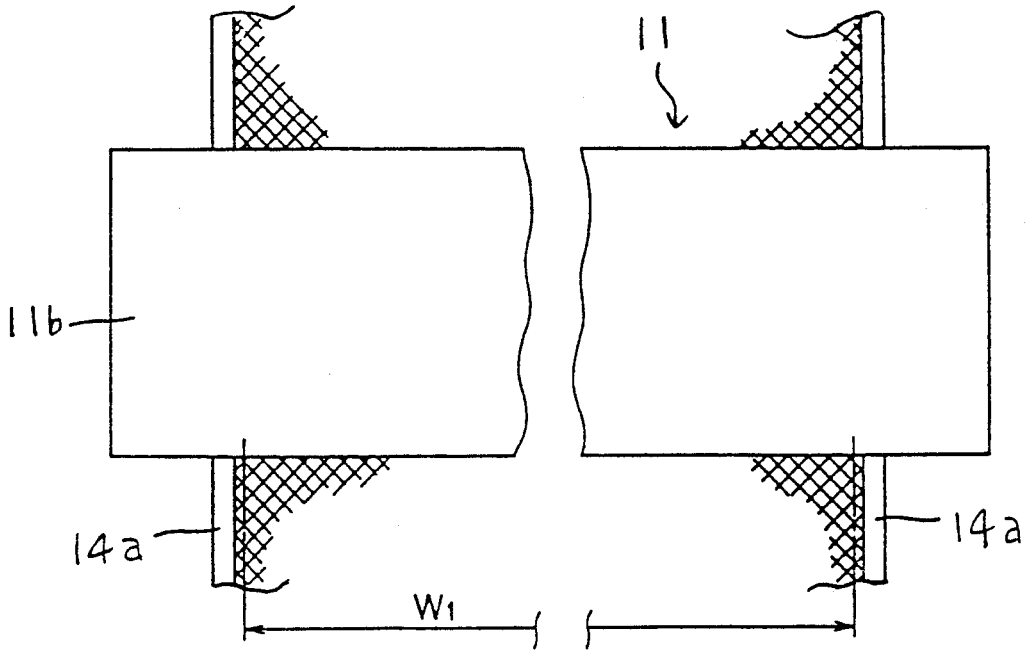
FIG. 7 is a schematic view showing the positional relationship between the developing roller and the mesh plate in a third example.
Figure 8A:
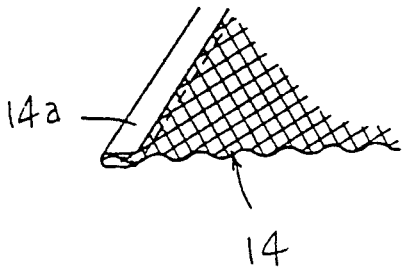
FIGS. 8*a* and 8*b* are perspective views showing protective strips fixed at edges of the mesh
Figure 8B:
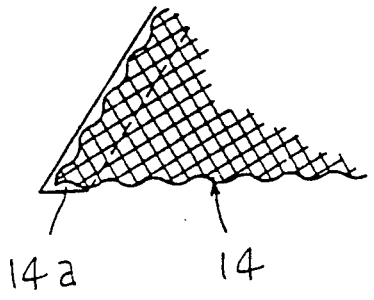

Referring to FIG. 7, the mesh plate 14 is longer than the axial length W1 on the urethane rubber surface where toner is coated but shorter than the length of the developing roller 11. The end portions of the developing roller 11 are covered with protective strips 14*a*. As shown in FIG. 8*a*, the strip 14*a* can be made by bending a plate with the mesh sandwiched or made of a sash to which the mesh is secured. The protective strips 14*a* are stuck to the mesh plate 14 with a heat-proof adhesive such as epoxy adhesive. The other structure is the same as Example 1.

Since each edge of the mesh plate 14 is covered by the protective strip 14*a*, the urethane rubber 11*b* is protected from being scratched by the edges of the mesh plate 14. Otherwise, a scratched urethane rubber is likely to cause the toner to scatter from the broken surface. When pressure development is carried out, a flash due to scratching is likely to damage the surface of the photosensitive drum 20 and peel the photosensitive layer on the drum 20. The life of the photosensitive drum 20 is prolonged. If the developing roller is damaged on the surface, frictional dust will be dispersed, and admixed with the toner. Such mixture is harmful to the formation of an image. The mesh plate 14 can withstand a long period of use.

Example 4

Figure 9:
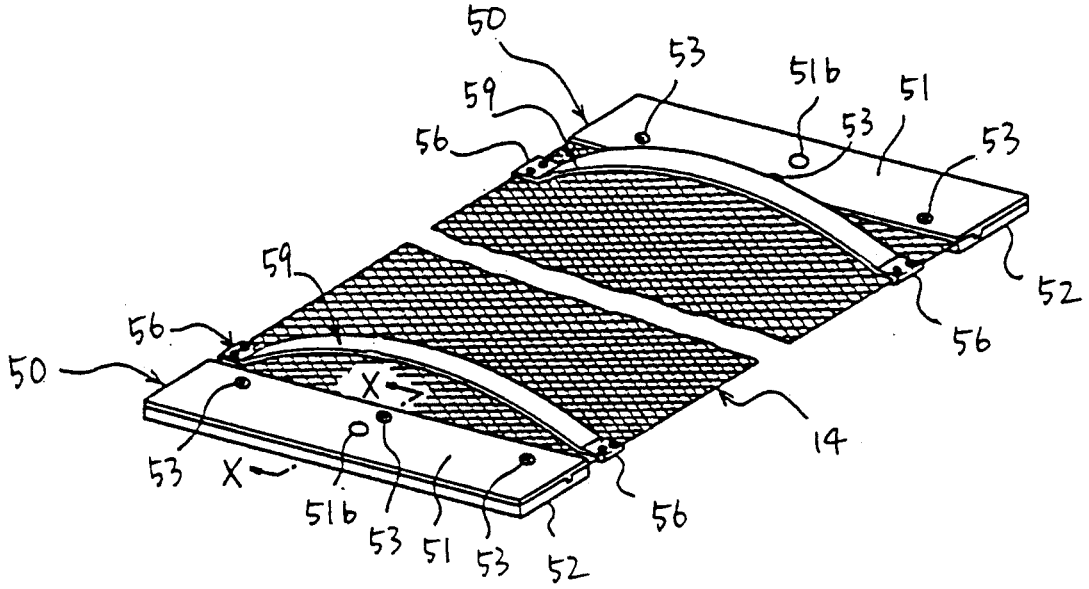
FIG. 9 is a perspective view showing a modified mesh plate used in a fourth example according to the present invention.
Figure 10:
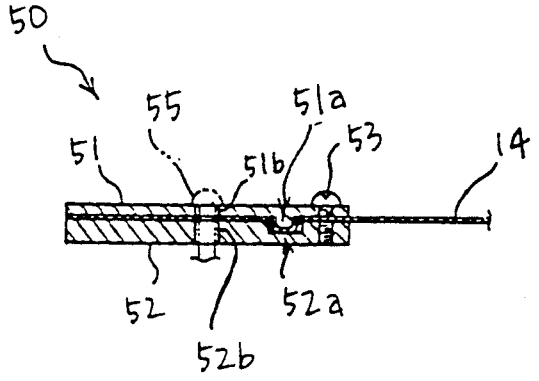
FIG. 10 is a fragmentary cross-section of a part of the modified mesh plate of FIG. 9.

Referring to FIG. 9, a fourth example will be described:

The mesh plate 14 is provided with mesh holders 50 at each side. As shown in FIG. 10, each mesh holder 50 includes an upper member 51 and a lower member 52 between which the edges of the mesh plate 14 is sandwiched. The upper member 51 includes a ridge 51*a* and the lower member 52 includes a groove 52*a* so that the ridge 51*a* fits in the groove 52*a* to effect the joint between the upper member 51 and the lower member 52. A mesh portion of the mesh plate 14 is forced into the groove 52*a* by the ridge 51*a*, thereby ensuring that the mesh plate 14 is secured between the upper member 51 and the lower member 52 which are joined by means of screws 53.

The upper member 51 and the lower member 52 are respectively provided with apertures 51*b* and 52*b* at central portions thereof which correspond to each other. One of the mesh holders 50 is fixed to the bottom of the housing 13 by means of a bolt 55 passed through the apertures 51*b* and 52*b*. The mesh holder 50 is fixed to the rotary shaft 15*a* (FIG. 1) disposed on the opposite side to the bottom of the housing 13 across the opening 13*a* by means of the bolt 55 passed through the apertures 51*b* and 52*b*.

Figure 11:
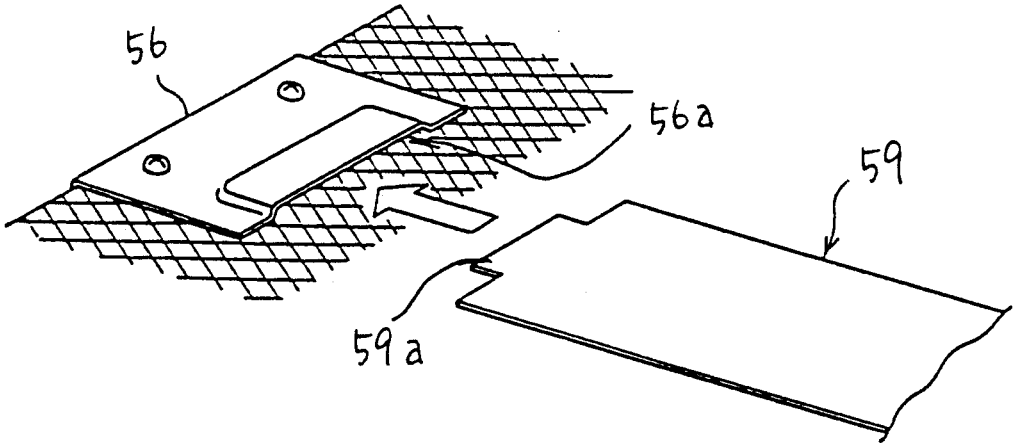
FIG. 11 is a perspective view on an enlarged scale showing the mesh plate, the spring board and the joint, particularly showing the assembling process of these members.

The mesh plate 14 is under tension imparted by spring boards 59 toward the developing roller 11. The spring boards 59 are made in a strip of flexible, tough metal, such as stainless steel and phosphor bronze. As shown in FIG. 11, the spring boards 59 are fixed to the mesh plate 14 through joints 56; more specifically, the joint 56 includes a pocket 56*a* in which a narrowed portion 59*a* of the spring board 59 is inserted as indicated by the arrow in FIG. 11. Since the spring boards 59 are longer than the axial length of the mesh plate 14, they tend to warp when they are fixed to the edges of the mesh plate 14, thereby imparting tension to the mesh plate 14. As a result, the mesh plate 14 is stretched without crease or slack. The other structure of this example is the same as Example 1.

The mesh plate 14 is kept in contact with the developing roller 11 under pressure, wherein the pressure is adjusted by the rotary shaft 15*a* so as to produce an optimum pressure for the developing roller 11. The absence of crease or slack enable the mesh plate to keep contact with the developing roller 11 at an even pressure.

Example 5

Figure 12:
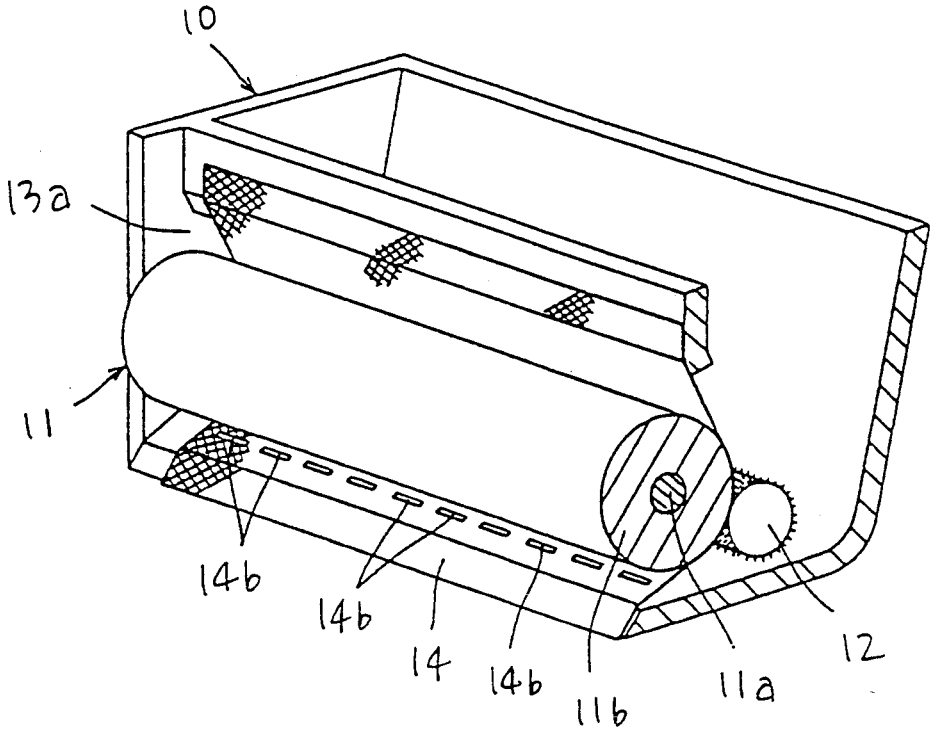
FIG. 12 is a perspective view showing the main portion of a fifth example according to the present invention.
Figure 13:
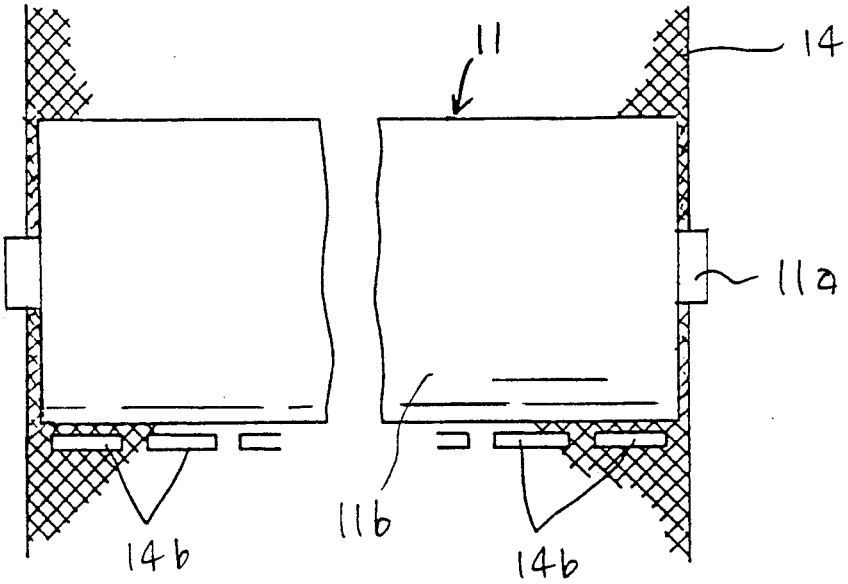
FIG. 13 is a schematic view showing a toner collecting means used in the developing device according to the present invention.

Referring to FIGS. 12 and 13, this example is characteristic in that the mesh plate 14 is provided with a plurality of toner collecting windows 14*b* aligned under the developing roller 11.

Part of the toner which did not participate in the development taking place on the photosensitive drum 20 is led into the collecting windows 14*b* and collected in the housing 13 for reuse.

Each collecting window 14*b* has an opening of such a size as to allow the toner to pass through. For example, when the toner has a grain size of about 10 μm, the collecting windows 14*b* preferably have openings of 0.2 to 2 mm by taking into consideration a possible aggregation. The shape of the collecting windows 14*b* can be rectangular, circular, oval or square.

Figure 14:
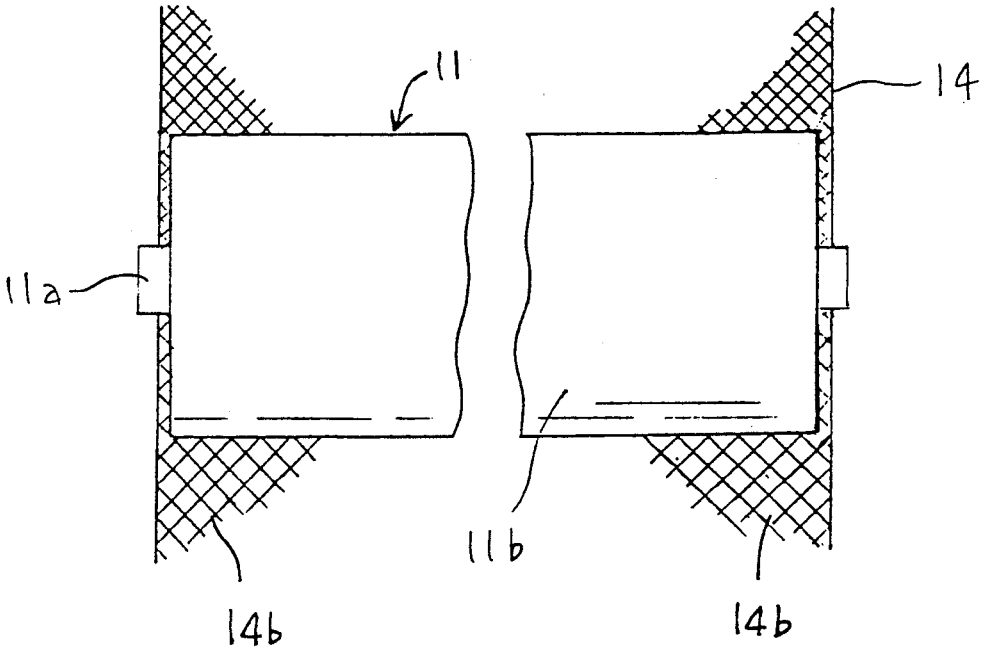
FIG. 14 is a schematic view showing another form of toner collecting means.

Because the toner is collected without dispersing, the toner is saved, and the resulting image is protected from being spoiled with the remainder of toner. FIG. 14 shows another form of toner collecting means which are provided by a mesh portion below the developing roller 11 having larger openings that those of the part above the developing roller 11.

Figure 15:
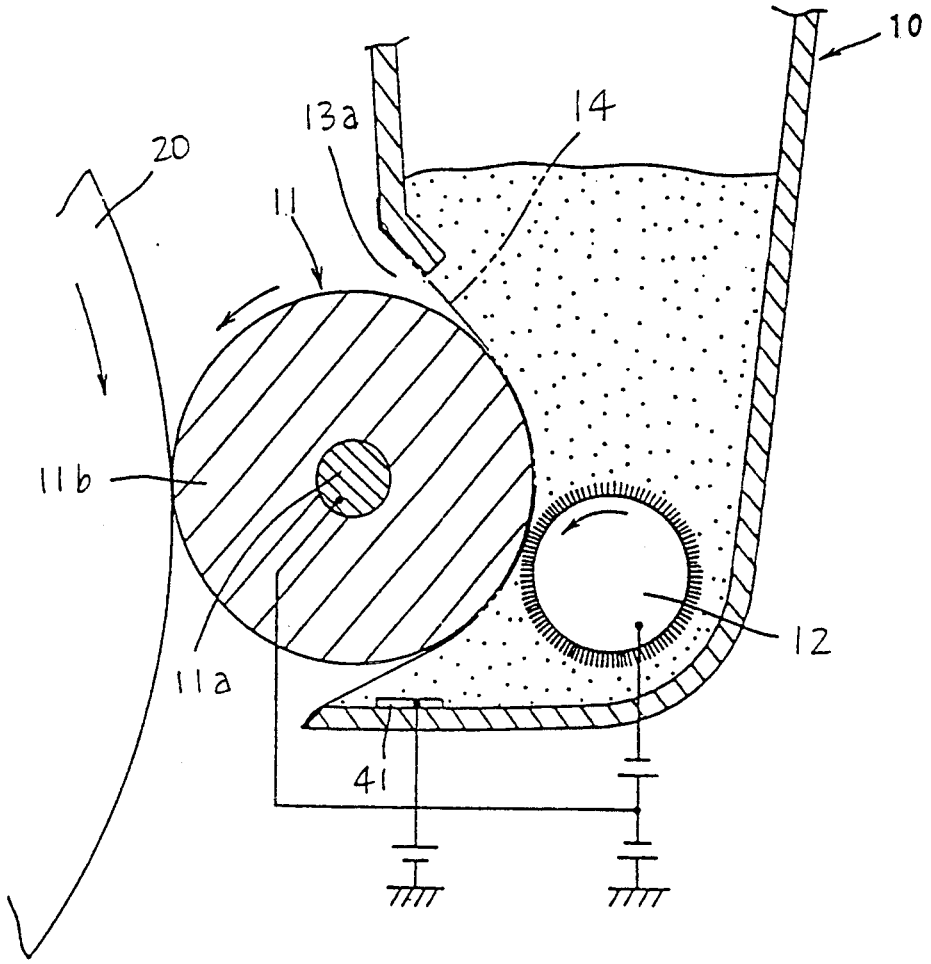
FIG. 15 is a cross-sectional view showing a developing device using a further form of toner collecting means.

Referring to FIG. 15, an electrode 41 is provided as a further form of toner collecting means. A potential of positive polarity (the opposite polarity of the toner) is applied to the electrode 41.

When the toner on the developing roller 11 passes the area of contact with the photosensitive drum 20, and is transferred to a position opposite to the mesh plate 14, it is attracted by the electrode 41 and forced into the housing 13 through the mesh plate 14. In this way the unused toner can be used again in the next cycle.

Figure 16:
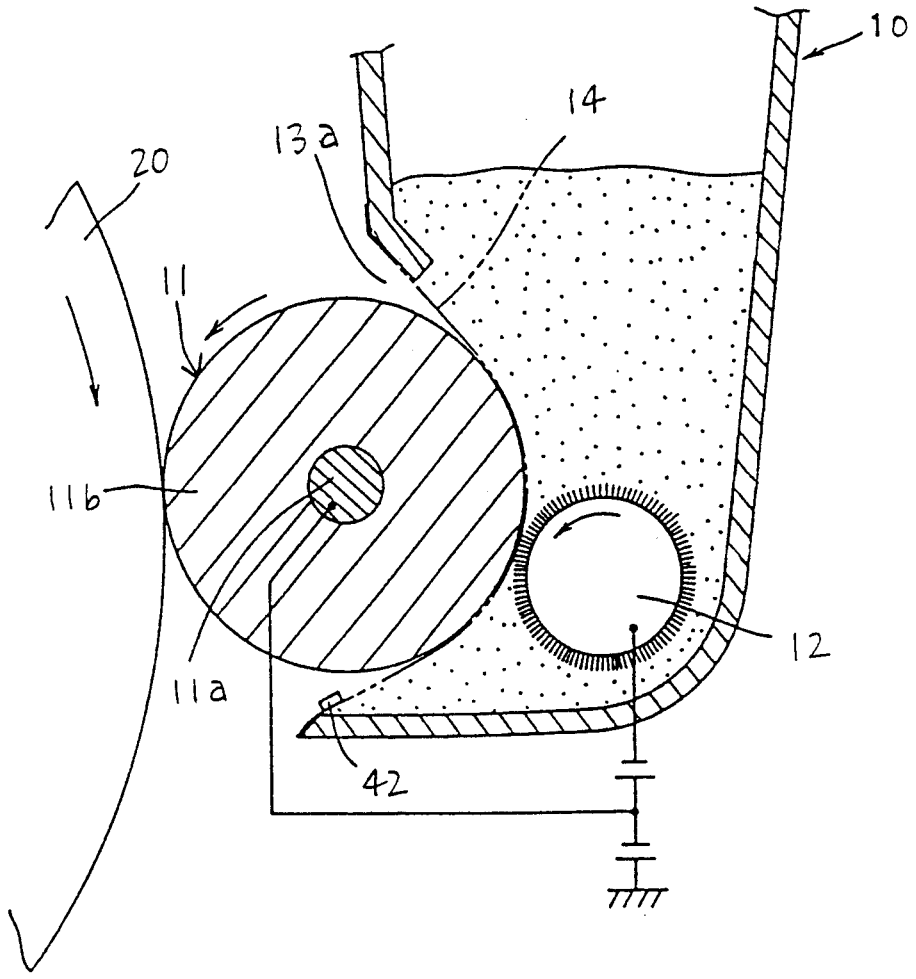
FIG. 16 is a cross-sectional view showing a developing device using a still further form of toner collecting means.

Referring to FIG. 16, a vibrator 42 is provided to impart vibration to the mesh plate 14. The other structure is the same as the embodiment shown in FIG. 15.

A piezoelectric element can be used as the vibrator 42 which generates supersonic wave oscillation in response to a voltage applied thereto. Alternatively, the vibration of the motor can be used by transmitting the vibration to the mesh plate 14 by use of a cam link.

When the toner is transferred to a position opposite to the mesh plate 14, it is forced through the mesh plate 14 under vibration and collected in the housing 13.

The embodiments having the collecting windows 14*b*, the electrode 41, and the vibrator 42 have been illustrated. They can be used independently or jointly with the combination of two or more.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A developing device comprising a housing including an opening toward a photosensitive drum, the housing containing a single-component toner, a developing roller disposed in the opening facing the photosensitive drum so as to transfer the toner to an image-forming area on the surface of the photosensitive drum, a porous plate disposed in the opening and kept in contact with the part of the developing roller positioned in the housing, the porous plate having pores of such a size as to allow the toner to pass through and a toner supply means for supplying the toner from the housing to the porous plate, the supply means including a roller.

2. A developing device according to claim 1, further comprising a first means for charging the toner with a desired polarity, and a second means for generating an electric field between the toner supply means and the developing roller whereby the charged toner is electromagnetically attracted to the developing roller.

3. A developing device according to claim 1, wherein the porous plate comprises a fixing means whereby the porous plate is fixed to the housing, the fixing means comprising means for equalizing the pressure acting on the developing roller.

4. A developing device according to claim 1, wherein the porous plate is not shorter than the axial length of the developing roller so that the porous plate is kept in contact with the full axial length of the developing roller.

5. A developing device according to claim 1, wherein the developing roller has an equal diameter at each end and has a smaller diameter in a central portion than that at the end.

6. A developing device according to claim 1, wherein the porous plate is provided with means for adjusting the pressure of the porous plate to the developing roller, the pressure adjusting means comprising means for adjusting the position of the porous plate with respect to the housing.

7. A developing device according to claim 1, wherein the porous plate has a shorter length than the axial length of the developing roller and the opposite edges of the porous plate are covered with strips on the sides where the porous plate is kept in contact with the developing roller.

8. A developing device according to claim 1, wherein the porous plate is provided with means for keeping the porous plate in contact with the developing device under an appropriate pressure applied along the axial length of the developing roller.

9. A developing device comprising a housing having an opening and containing a single-component toner, a photosensitive drum, a developing roller positioned to transfer the toner from the housing to an image-forming area on the surface of the photosensitive drum, a porous plate disposed in the opening and in contact with the developing roller, the porous plate having pores of such a size as to allow the toner to pass through, and a toner collecting means for collecting toner through the porous plate, wherein the toner collecting means comprises a window disposed on the porous plate, and having a larger opening than the pores of the porous plate.

10. A developing device comprising a housing having an opening and containing a single-component toner, a photosensitive drum, a developing roller positioned to transfer the toner from the housing to an image-forming area on the surface of the photosensitive drum, a porous plate disposed in the opening and in contact with the developing roller, the porous plate having pores of such a size as to allow the toner to pass through, and a toner collecting means for collecting toner through the porous plate, wherein the toner collecting means is an electrode having an opposite polarity to that of the toner so as to attract the toner, 11. A developing device comprising a housing having an opening and containing a single-component toner, a photosensitive drum, a developing roller positioned to transfer the toner from the housing to an image-forming area on the surface of the photosensitive drum, a porous plate disposed in the opening and in contact with the developing roller, the porous plate having pores of such a size as to allow the toner to pass through, and a toner collecting means for collecting toner through the porous plate, wherein the toner collecting means is a vibrator for imparting vibration to the porous plate.

* * * * *

UNITED STATES PATENT AND TRADEMARK OFFICE

CERTIFICATE OF CORRECTION

PATENT NO. : 5,166,472

DATED : November 24, 1992

INVENTOR(S) : Masahiko MAEDA et al.

It is certified that error appears in the above-identified patent and that said Letters Patent is hereby corrected as shown below:

In Column 12, Claim 10, line 19, delete "," and insert --.--.

Signed and Sealed this

Second Day of November, 1993

Bruce Lehman

*Attest:*

BRUCE LEHMAN

*Attesting Officer*

*Commissioner of Patents and Trademarks*